US006823999B2

(12) United States Patent
Heneveld, Sr.

(10) Patent No.: US 6,823,999 B2
(45) Date of Patent: Nov. 30, 2004

(54) PIVOTING STORAGE ORGANIZER BRACKET SYSTEM

(76) Inventor: William R. Heneveld, Sr., 7484 Candlewood Dr., Grand Rapids, MI (US) 49546

( * ) Notice: Subject to any disclaimer, the term of this patent is extended or adjusted under 35 U.S.C. 154(b) by 0 days.

(21) Appl. No.: 10/215,579

(22) Filed: Aug. 9, 2002

(65) Prior Publication Data

US 2003/0029820 A1 Feb. 13, 2003

Related U.S. Application Data

(60) Provisional application No. 60/311,611, filed on Aug. 10, 2001.

(51) Int. Cl.[7] ..... A47F 5/08

(52) U.S. Cl. ..... 211/87.01; 211/100; 211/106; 248/75; 248/90

(58) Field of Search ..... 211/87.01, 85.11, 211/90.03, 54.1, 57.1, 59.1, 169, 171, 96, 90.02, 100, 101, 106, 81, 99, 90.01, 88.01, 170, 110, 168, 116, 80, 47, 48; 248/75, 79, 89, 90, 91, 92, 93, 289.31, 290.1, 294.1, 308, 213.1, 299.1; 16/250, 252, 382, 319, 337, 349, 350

(56) References Cited

U.S. PATENT DOCUMENTS

| | | | | |
|---|---|---|---|---|
| 672,417 A | | 4/1901 | Field | |
| 675,925 A | * | 6/1901 | Blair | 348/294.1 |
| 687,431 A | | 11/1901 | Kimball | |
| 707,192 A | | 8/1902 | Aiken | |
| 1,097,258 A | | 5/1914 | Noble et al. | |
| 1,203,412 A | * | 10/1916 | Rosenfeld et al. | 248/92 |
| 1,234,267 A | | 7/1917 | Bennett | |
| 1,236,266 A | * | 8/1917 | Chaikin | 211/96 |
| 1,347,116 A | | 7/1920 | Morgan | |
| 1,376,546 A | * | 5/1921 | Jeep | 248/304 |
| 1,473,318 A | * | 11/1923 | Ranson | 211/97 |
| 1,824,710 A | * | 9/1931 | De Carlo | 211/31 |
| 2,051,408 A | | 8/1936 | Karst | |
| 2,158,616 A | * | 5/1939 | Blameuser | 211/100 |

U.S. PATENT DOCUMENTS

FOREIGN PATENT DOCUMENTS

| | | |
|---|---|---|
| DE | 2758582 | 7/1979 |
| NO | Nr79269 | 10/1951 |

OTHER PUBLICATIONS

Exhibit A includes photos of a prior art bracket made by Sterling Co. prior to the present invention, the bracket including a two–piece riveted base and a U–shaped pivoting arm with a welded–on stop finger.

*Primary Examiner*—Carl D. Friedman
*Assistant Examiner*—Jennifer E. Novosad
(74) *Attorney, Agent, or Firm*—Price, Heneveld, Cooper, DeWitt & Litton

(57) ABSTRACT

A storage organizer includes a U-shaped bent-wire storage member pivotally mounted on a plate-like base to a wall or stud. The base has a pair of arcuately-shaped bands that define a pocket against the wall, and the bent-wire storage member has a pair of aligned straight sections that rotatably engage the pocket, permitting movement of prongs of the storage member between an upright storage position and an outward use position. The bent-wire storage member further includes an offset bent section between the straight sections that abuts forwardly-bent material between the bands to form a stop to hold the bent-wire storage member in the use position.

24 Claims, 9 Drawing Sheets

U.S. PATENT DOCUMENTS 2,477,977 A 8/1949 Gelb
2,634,032 A * 4/1953 Bartlett ..... 223/88
2,706,049 A * 4/1955 Andrews ..... 224/482
2,778,588 A * 1/1957 Capocci ..... 248/112
2,842,264 A 7/1958 Larson
2,936,146 A 5/1960 Wunder
3,033,377 A * 5/1962 Inman ..... 211/96
3,158,348 A 11/1964 Rutter
3,198,343 A 8/1965 Pollock
3,233,745 A * 2/1966 Herschberger ..... 211/104
3,269,550 A 8/1966 Marcus
3,386,589 A * 6/1968 Prete, Jr. ..... 211/118
3,484,069 A * 12/1969 Larson ..... 248/220.42
3,522,970 A 8/1970 Francis
3,556,023 A 1/1971 Marschak
3,698,565 A 10/1972 Weber
3,762,593 A 10/1973 Beretta
4,044,983 A * 8/1977 Francis ..... 248/291.1
4,051,953 A * 10/1977 Shoaf ..... 211/119.1
4,101,107 A * 7/1978 Antoszewski ..... 248/218.4
4,113,131 A 9/1978 Joseph
4,241,669 A 12/1980 Giambalvo
4,356,922 A * 11/1982 Dierksheide ..... 211/85.11
4,366,908 A 1/1983 Anderson
4,382,640 A 5/1983 Kashden
4,456,125 A 6/1984 Chap
4,476,606 A * 10/1984 Bjorkman et al. ..... 15/268
4,512,481 A 4/1985 Thalenfeld
4,526,285 A 7/1985 Cerveny et al.
D294,668 S 3/1988 Handler et al.
4,765,495 A 8/1988 Bisk
4,836,479 A * 6/1989 Adams ..... 248/89
4,848,620 A 7/1989 Chap
4,893,770 A 1/1990 Bejak et al.
4,917,337 A 4/1990 Gridley
5,078,276 A * 1/1992 Rogge et al. ..... 211/18
5,086,936 A 2/1992 Remmers
5,125,518 A 6/1992 Ward
5,178,287 A * 1/1993 Klein et al. ..... 211/100
5,193,695 A * 3/1993 Mann ..... 211/104
D343,712 S 1/1994 Linder
D348,760 S 7/1994 Linder
5,330,063 A 7/1994 Remmers
5,379,536 A 1/1995 Lorenzana
5,423,437 A 6/1995 Kayem
5,443,173 A 8/1995 Emery et al.
5,460,279 A 10/1995 Emery et al.
5,482,168 A 1/1996 Welch et al.
5,743,416 A 4/1998 Yemini
5,782,447 A * 7/1998 Hoffend ..... 248/215
5,810,179 A 9/1998 Kleiman
5,855,347 A 1/1999 Hollingsworth et al.
5,944,293 A * 8/1999 Loy ..... 248/220.21
6,085,917 A * 7/2000 Odom ..... 211/119.003
6,089,383 A 7/2000 Heneveld

* cited by examiner

PIVOTING STORAGE ORGANIZER BRACKET SYSTEM

CROSS-REFERENCE TO RELATED APPLICATIONS

This application claims benefit of provisional application Ser. No. 60/311,611, filed Aug. 10, 2001, entitled STORAGE ORGANIZERS.

BACKGROUND OF THE INVENTION

The field of the present invention is storage organizers. More particularly, the field of the present invention relates to wall-mounted devices for the storage of loose articles.

Storage organizers come in many types and styles. Their utility has increased over time as a result of the tendency to accumulate numerous gadgets, devices, and other items associated with the contemporary lifestyle. Given the fact that many homeowners have confronted the ever-decreasing amount of storage space, the advent of devices and methods for maximizing the amount of storage that can be obtained has developed into its own industry.

Very basic to the foregoing premise is the development of wall-mounted shelving. Many times in garage and basement space, the homeowner is able to purchase brackets and support systems that allow shelving to be installed by directly mounting the hardware onto the surface of a wall or onto a stud that is used as part of the framing of the garage or basement space. These wall-mounted systems are well known in the art and have served great utility over time. They obviously will continue to do so since they do provide a substantial support. However, they are typically directed towards applications where many feet of shelving space are involved.

Other storage devices have developed over time and are well known, such as wall-mounted hooks or brackets. These are static devices that merely provide a support point along the surface of a wall or a stud, whereby the homeowner is free to hang or drape objects onto the support. Devices of this type probably go back more than 150 years in time, when they may have held a bow or a quiver of arrows, or a musket and a powder horn.

More contemporary devices are known whereby the traditional wall-mounted shelving may be replaced by wire structures. Again, these wire structures are similar to the shelving in providing linear footage along the support system and are extremely useful in those circumstances when large amounts of goods need to be stored in this fashion.

Other devices and advances on the described prior art, above, are know as well. In short though, all of these approaches have the same objective in mind, that being the enhancement of a storage space in a fixed area such as a garage or basement.

Difficulties with the prior art do exist, and these relate to the mounting and fastening techniques that are required. Many times, the system approach for wall-mounted shelving, for instance, is not compatible with the particular stud spacing that is provided within the given storage environment. In these instances, maximization of the supporting ability of the product is limited owing to installation directly into wallboard rather than into a stud itself. Additionally, the utilization of such prior art storage devices is not readily amenable to the potential applications. As a result, attachment to surfaces such as wallboard, peg board, or direct mounting within conventional stud spacing requires a different approach and many times, different hardware for each. Thus, the homeowner is left to contemplate the particular architecture that he is confronting as well as the need to acquire additional tools and/or fasteners in order to overcome the incompatibilities that he is presented with.

Accordingly, a storage system is desired that solves the aforementioned problems and has the aforementioned advantages.

SUMMARY OF THE INVENTION

The present invention relates to a storage organizer that is simultaneously mountable onto the surface of a conventional flat wall system, such as a drywall composition. The storage organizer is also mountable onto a perforated panel, such as a pegboard, or in a manner consistent with conventional stud spacing.

In accordance with the present invention, a organizer shelf with integrally formed sidewalls and with a front portion and a rear portion, is formed in a width that is compatible with insertion between the area that may be exposed between supporting studs in a garage or basement area. Further, the present invention includes engagement areas whereby it may be directly mountable onto fasteners that have been attached to the sides of the exposed studs.

The present invention also contemplates the usage of a formed-wire organizer that similarly has the capabilities for mounting onto a flat wall surface, a perforated panel or pegboard surface, or for insertion in between exposed studs in a garage or basement area. The formed-wire organizer embodiment of the present invention also contains an engagement area compatible with the installation of the invention onto the fasteners that had been mounted into the sides of the studs.

The present invention further includes a storage organizer, comprising a pivotable pronged assembly, that is mated to a base plate and captured against a flat wall surface or directly onto a stud. The storage organizer uniquely provides for supportable storage of goods that can be hung or laid across the pronged assembly. Further, when not in use, this embodiment allows for the movement of the prongs to a "stored-"position such that they do not project out from the surface to which they are mounted. Therefore, the prongs are unobtrusive and prevent accidental contact by the homeowner when traversing through the garage or basement area.

In one aspect of the present invention, a storage organizer is provided that is adapted for attachment to a building wall, a two-by-four stud, or other structure having a flat surface for creating storage thereon. The storage organizer includes a base plate with at least one support pocket defining a horizontal axis of rotation, and a U-shaped storage member having a pronged body and pronged arms extending from the pronged body. The pronged body has at least one straight section positioned within the support pocket for rotation about the axis of rotation, with the pronged arms being movable between an upright storage position and a downwardly-pivoted extended use position. The pronged body further has an offset bent section integral with and extending from the straight section. The offset bent section is bent at a predetermined angle to the pronged arms so that, when the pronged arms are in the extended use position, the offset bent section engages the base plate to hold the pronged arms in the extended use position.

In another aspect of the present invention, a storage organizer is adapted for positioning between and attachment to studs of a building wall for creating storage in and along the building wall, where the studs have a known horizontal space therebetween and where the building wall includes a panel attached to a rear side of the studs to close one side of the horizontal space and where fasteners are located in the sides of the studs at a predetermined dimension forward of the panel and between the studs. The storage organizer includes a storage unit having opposing sides and a bottom structure. The sides each include downwardly-open notches proximate but spaced forwardly from a rear of the sides and spaced above the bottom structure. The storage unit has a width dimension chosen and adapted to fit into the space between the studs, with the notches being shaped and adapted to securely receive but releasably engage the fasteners to create a torque force in combination with the rear portion of the bottom structure for holding the storage unit in a use position. By this arrangement, the storage unit is constructed and adapted to slip between the studs and downwardly onto the fasteners with the notches engaging the fasteners and with a bottom portion of the rear engaging the panel to hold the storage unit in a use position.

In another aspect of the present invention, a kit is provided for constructing a storage organizer, where the organizer is attachable to different support structures. The kit includes a storage unit having opposing sides and a bottom structure defining a width that is adapted to fit between vertically opposing surfaces and against a panel attached to an outside surface of the vertically opposing surfaces. The sides have side-facing connectors adapted to engage headed fasteners on the vertically opposing surfaces. The side-facing connectors are spaced above the bottom structure, so that the storage unit can be hung on the fasteners with a portion of the bottom structure engaging the panel, with the storage unit being held in cantilever between the vertically opposing surfaces and against the panel. A rear portion of the storage unit includes a plurality of rear-facing connectors adapted to receive fasteners to retain the storage unit in cantilever from a flat wall surface.

In one form, the rear-facing connectors include apertures for receiving screws, and further include anchors that are extendable into holes in a perforated panel for receiving the screw. In a narrower form, a combination includes a perforated panel with regularly spaced holes, and the anchors of the kit are shaped to frictionally engage selected ones of the holes for supporting the storage unit on the perforated panel.

In another aspect of the present invention, a storage organizer includes a storage unit having a bottom and sides. The storage unit is made from formed-wire, with each side having wire sections defining a downwardly open V-shaped notch that is shaped and adapted to receive and engage a screw extending laterally into the side. The open V-shaped notch terminates in a narrowed area that wedges and clamps against the screw, with the narrowed area being above the bottom. By this arrangement, the storage unit can be lowered onto a pair of opposing screws that extend inwardly from opposing directions, with the screws wedging into the notches on the sides to support a weight of the storage unit and items stored thereon.

In another aspect of the present invention, a storage organizer comprises a storage unit having a bottom, sides, and a rear. The rear includes a rear bar of material. A clip has a pair of legs and a resilient section that wraps around the rear bar with the pair of legs positioned proximate each other. The legs each include an aperture for receiving a fastener. The resilient section is sufficient in strength to engage the rear bar and hold the storage unit when only one of the legs is attached to a support surface, but flexible to permit the second leg to be flexed adjacent the first leg so that both the first and second legs can be engaged by a single fastener.

It is an object of the present invention, therefore, to provide a series of storage organizers that have a high degree of compatibility for the various installation environments.

It is also an object of the present invention to provide storage organizers that are self-contained in that no additional accumulation of components other than the unit itself (and the fasteners) is required for installation.

These and other aspects, objects, and features of the present invention will be understood and appreciated by those skilled in the art upon studying the following specification, claims, and appended drawings.

DETAILED DESCRIPTION OF PREFERRED EMBODIMENTS

Storage organizers, in accordance with the present invention, are oriented towards maximizing the utilization of a given space. References within this specification to the subject space as being a garage or basement area are meant for purposes of illustration. The storage organizers of the present invention may be installed in any compatible space or environment, typically those that have flat-walled surfaces, exposed stud walls, vertically opposing surfaces, or have perforated panels, such as pegboard surfaces, such that the advantages of the present invention can be obtained.

Additionally, the storage organizers of the present invention are being shown as complete units. It is understood that they may be formed from multiple separate components and brought together for installation in the intended application. However, commercially, it is believed that the formation and the packaging and marketing of these products as complete individual units are highly preferred over the alternatives.

Figure 1:
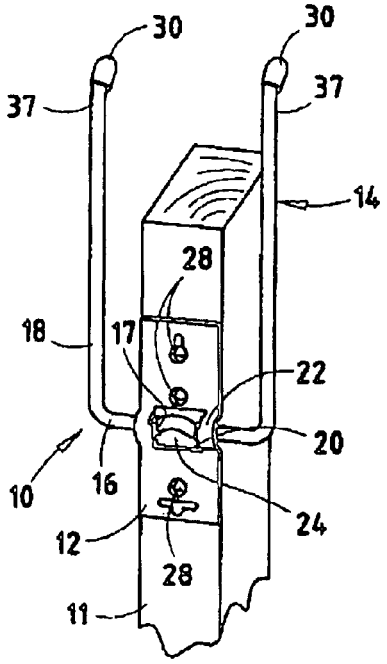
FIG. 1 is a perspective view of a pronged organizer of the present invention as mounted onto a stud, the pronged organizer being shown in an upright "stored"position.
Figure 2:
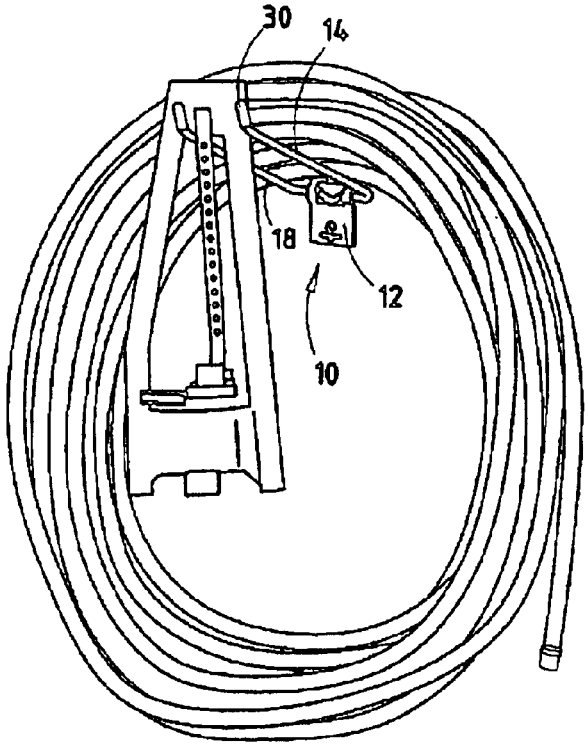
FIG. 2 is a perspective view of the pronged organizer of FIG. 1, with the prongs being in an extended outward position where the prongs projecting outward from the base, and with exemplary products being stored thereon.

Turning now to FIG. 1, a pronged storage organizer of the present invention is shown in perspective view as being installed onto an exposed stud 11. The pronged storage organizer 10 includes a base 12 formed from a flat plate, and a U-shaped bent-wire storage member 14 positioned under the base 12 against a supporting surface of the stud 11. The storage member 14 is formed from a section of heavy wire or steel rod, and includes a pronged body 16 and a pair of pronged arms 18 that project from ends of the pronged body 16. More specifically, the pronged body 16 comprises a pair of spaced-apart aligned straight sections connected together by an offset bent section 24 (sometimes called a "prong support"). The base 12 includes a pair of spaced prong support brackets or bands 22*a* and 22*b* under which the straight sections of the pronged body 16 are positioned for rotation. Rubber bands or strips of elastic material 17 are placed on the straight sections under the pronged brackets 22*a* and 22*b* to form a stable frictional arrangement where the storage member 14 is selectively rotatable to a storage position (FIGS. 1 and 4) or a use position (FIG. 2). The storage member 14 stays in the selected position due to the friction generated by the bands of material 17 under the brackets 22*a* and 22*b*. In the stored position, the arms 18 are oriented in the upward position (as shown by the arrow in FIG. 3) which keeps the prongs from projecting outwards from the base 12. This reduces the chance of interference between the homeowner/user of the present invention and the pronged arms themselves.

Figure 3:
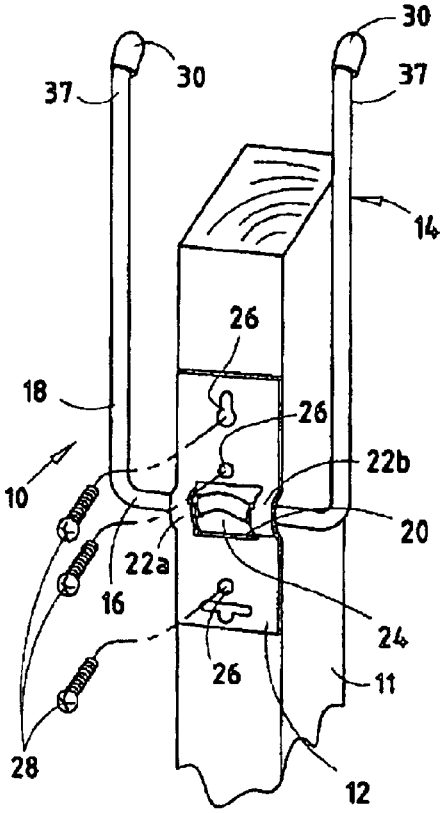
FIG. 3 is a perspective view of the pronged organizer of FIG. 1 showing the installation components for installing the organizer on a stud.
Figure 4:
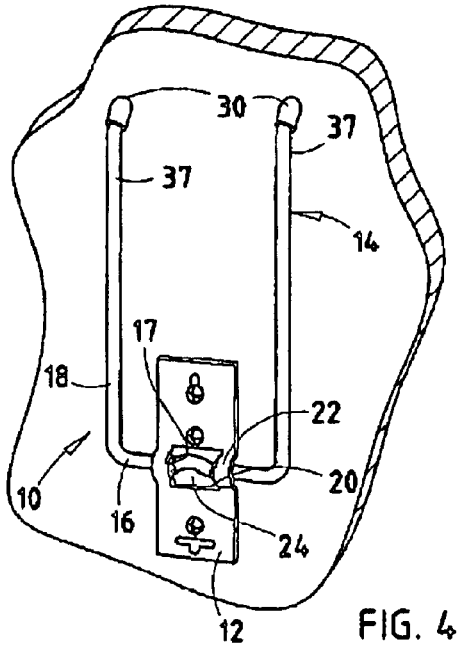
FIG. 4 is a perspective view of a pronged organizer of FIG. 1 but mounted on a flat wall surface.

Turning now to FIG. 3, the pronged organizer 10 is shown as being installed onto an exposed stud. In addition to the other components discussed previously, FIG. 3 also shows the slot or window 20 with the pronged brackets 22*a* and 22*b* on opposite sides of the slot 20. The brackets 22*a* and 22*b* are bands of material that extend arcuately between the top and bottom plate sections of the base 12. The bands 22*a* and 22*b* form a support surface defining an axis of rotation for rotationally receiving and supporting the prong support 24 (i.e. the offset bent section) of the pronged body 16. The bands 22*a* and 22*b* trap the pronged body 16 against the stud 11 to which the base 12 is attached, and with the frictional rubber bands or sleeves 17 that encircle the straight sections of the pronged body 16, form a tight but operable assembly permitting rotation of the storage member 14 between the upright storage position (FIG. 1) and the downwardly rotated use position (FIG. 2).

Located on the base 12 are the mounting holes 26, which are associated with the screws 28 for securing the base 12 to a stud. Other fasteners can of course be used instead of screws.

The pronged arms 18 terminate in the pronged arm ends 37 and the pronged tips 30. The pronged arm ends 37 in the preferred embodiments are angled somewhat upwardly as the pronged arms would be viewed in the operating position. This angle is to assist in the retention of stored goods on the pronged arms 18 and also to prevent their accidental disengagement from the device. The pronged tips 30 are plastic caps that fit onto the ends of the pronged arms 18. The tips 30 protect the homeowner/user from coming into accidental injurious contact with the end of a pronged arm and thereby accidentally causing abrasion or cuts.

Figure 4A:
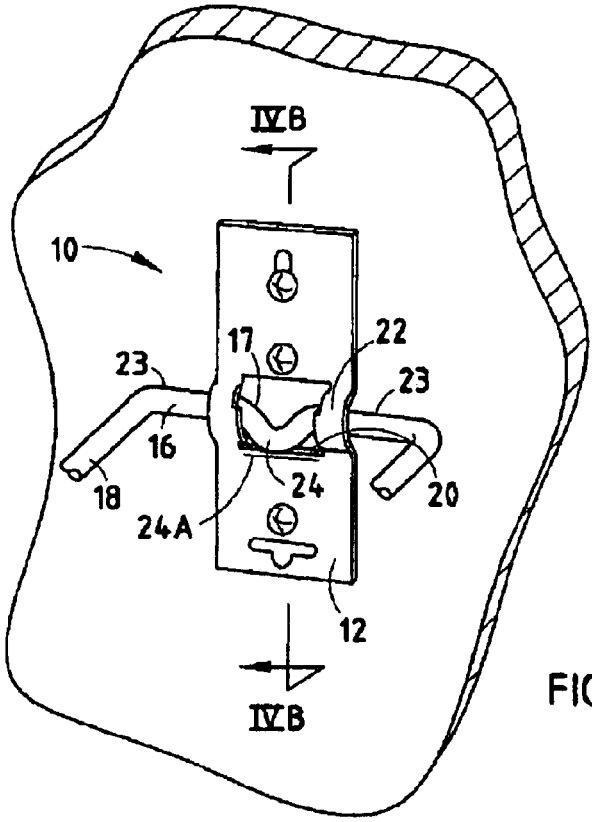
FIG. 4A is an enlarged view of the storage organizer shown in FIG. 2 with the parallel prongs in the use position.
Figure 4B:
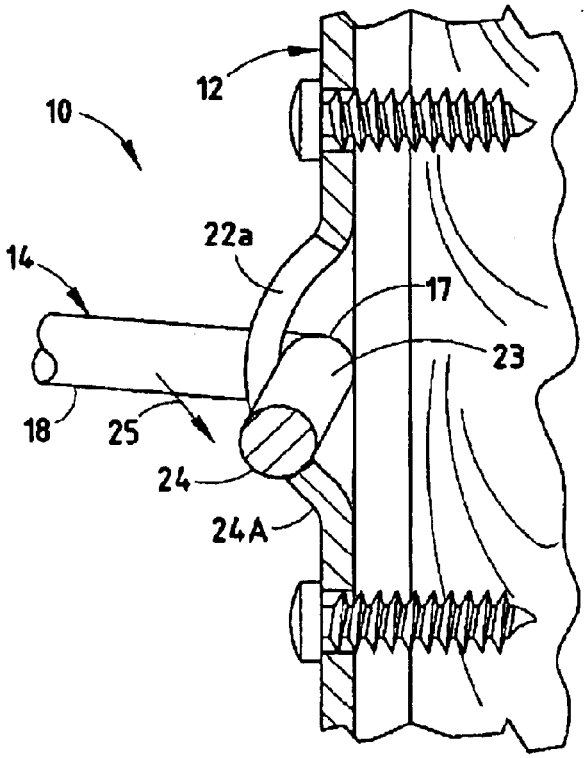
FIG. 4B is a cross section taken along the line IVB—IVB in Fig. 4A.
Figure 5:
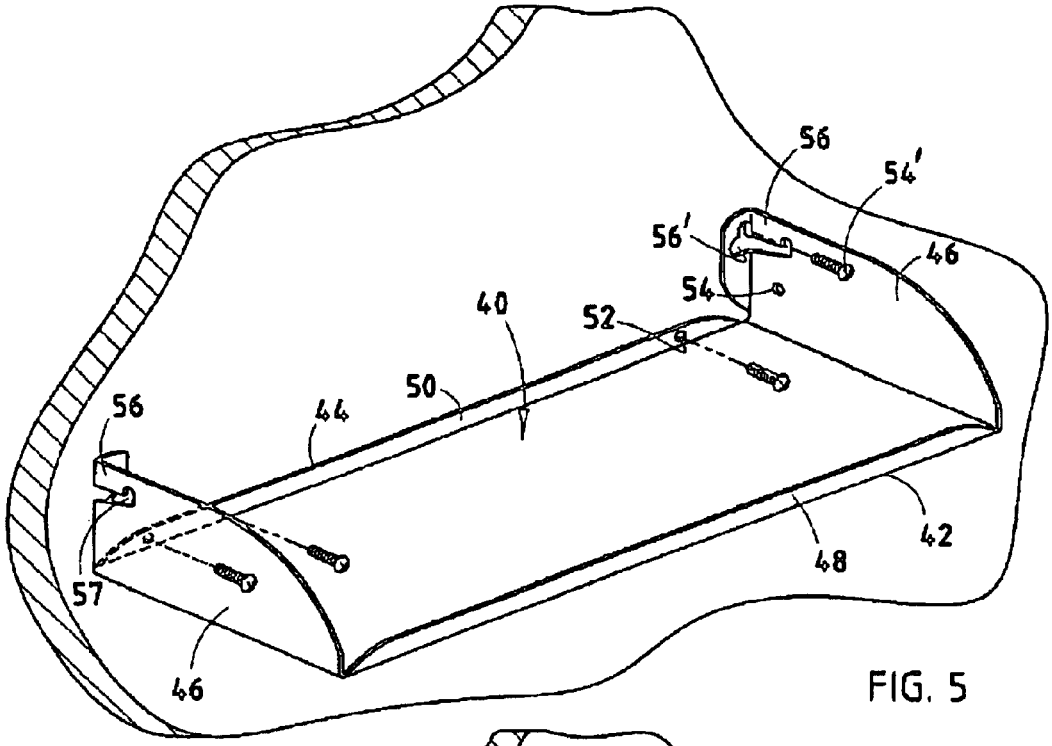
FIG. 5 is a perspective view of an organizer shelf of the present invention as it would be mounted onto a flat-walled surface and showing installation screws exploded away.
Figure 6:
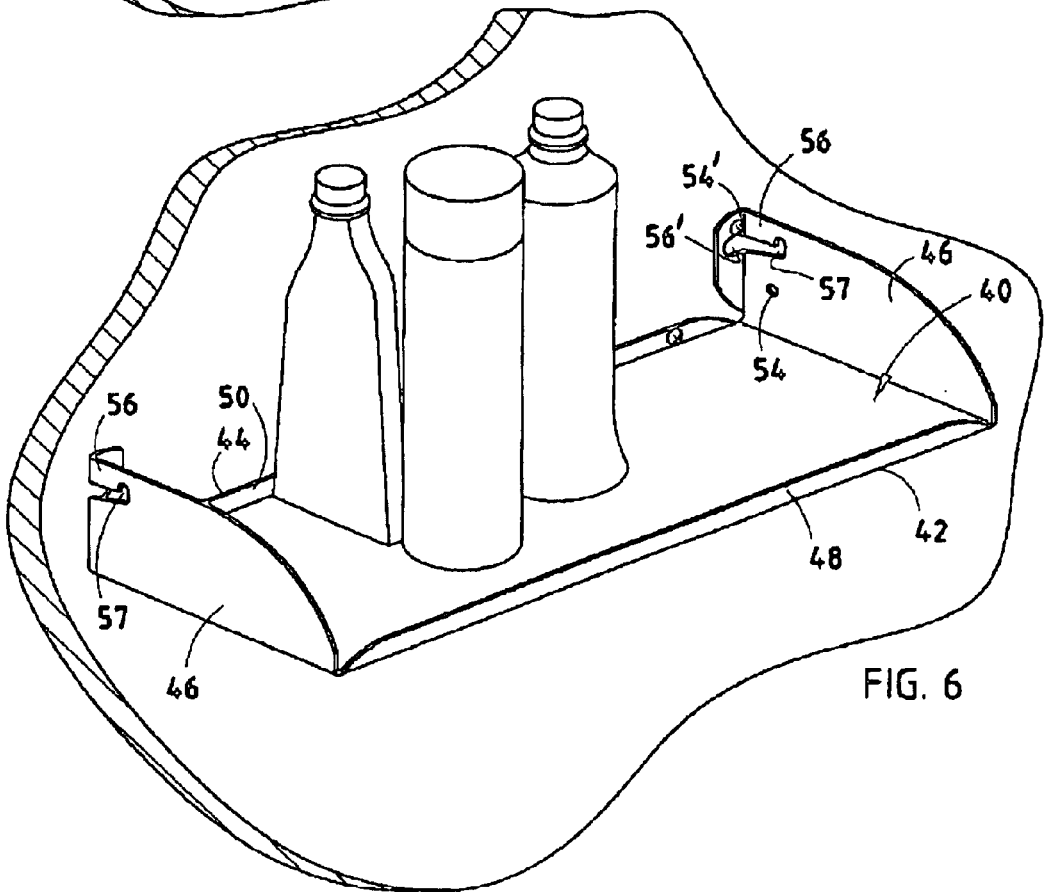
FIG. 6 is a front perspective view of the organizer shelf of FIG. 5 and mounted on the flat-walled surface.
Figure 7:
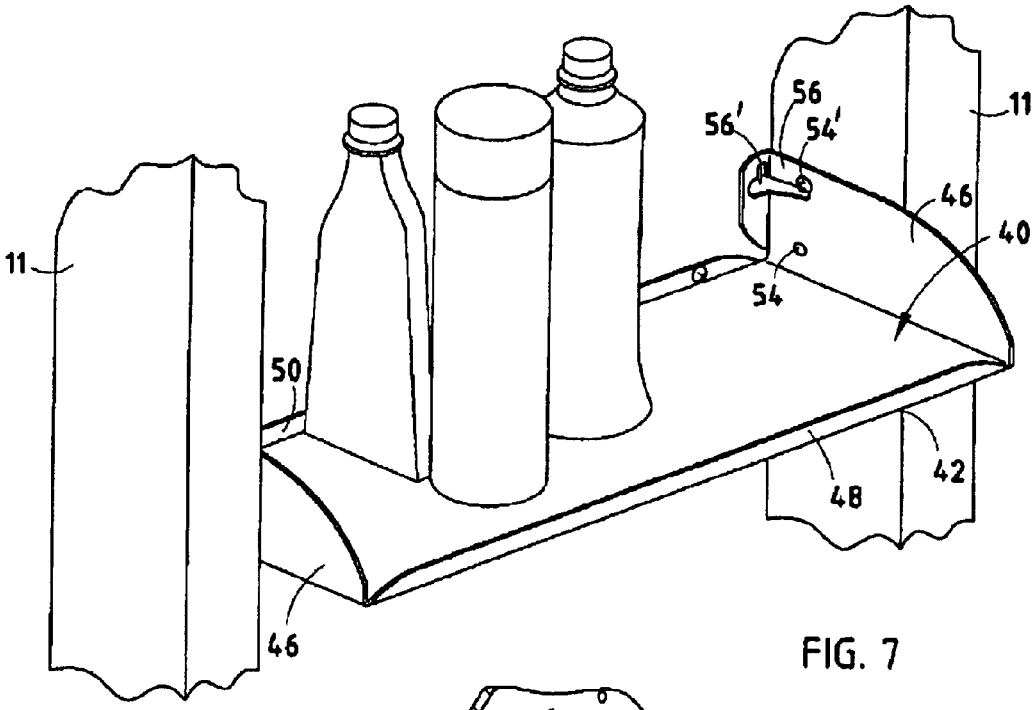
FIG. 7 is a front perspective view of the organizer shelf of FIG. 5 but mounted between a pair of studs forming an unfinished wall.
Figure 8:
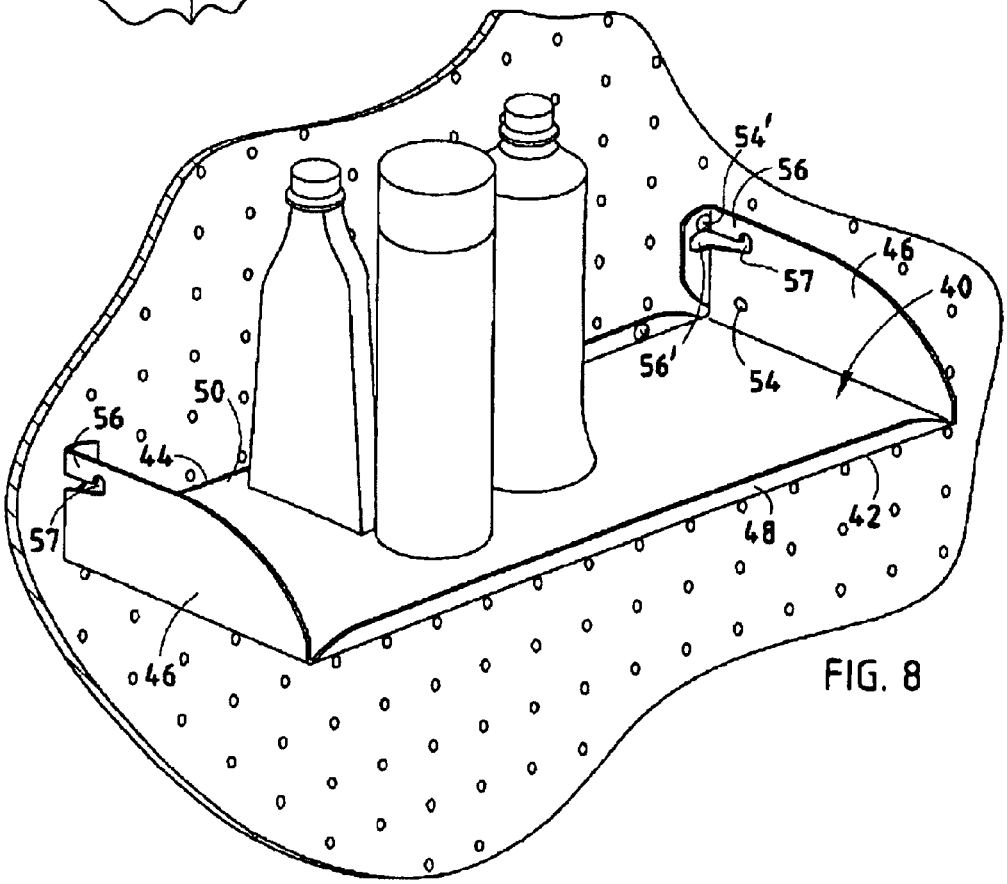
FIG. 8 is a front perspective view of an organizer shelf of FIG. 5, but mounted onto a perforated panel, such as a pegboard, and showing containers of products stored thereon.

As may now be appreciated from the foregoing the storage organizer 10 of the present invention is selectively mountable onto an exposed stud (FIG. 3), or onto a flat-walled surface (FIG. 4) using screw mount attachments. In most cases of a flat-walled surface, such as in a gypsum wall or paneling, an appropriate anchor (see FIG. 17) and/or a screw (not shown) can be used. One of the benefits of the present invention lies in the interaction between the pronged support 24 and the slot 20. As the user moves the pronged arms 18 from a stored position to an operating position, the pronged support 24 will contact a bottom of the slot 20 and prevent any further advancement of the arms below that point. This contact and any downward force on the pronged arms 18 pulls the pronged body 16 into the bands 22*a* and 22*b*, thus engaging them more securely. Therefore, the position of the pronged arms 18 can be fixed by forming the pronged support 24 in the appropriate manner along the center portion of the pronged body 16. The selection of the angle of the projection of the pronged support 24 relative to the pronged arms 18 will cause the pronged arms 18 to rest substantially horizontal (but with the outer ends slightly inclined upwardly) when lowered to the operating position. In the preferred embodiment, it is desirable to have the pronged arms 18 land in an operating position where they are slightly angled above the horizontal plane, such as 5° to 15°, and most preferably about 13°. This allows for some deflection as a load is placed on the pronged arms 18 and also helps in retention of any goods stored onto the pronged arms 18 themselves. The angle of the pronged arms 18 in the use position is affected by the thickness and forming of the base plate 12. In the preferred embodiment, the section of material of base 12 located under the window aperture between the bands 22*a* and 22*b* is flat, except for the marginal material 24A forming a bottom of the window. This marginal material 24A is bent forwardly slightly to define a stop that abuts the offset bent section 24 between the aligned straight sections 23 of bent wire storage member 14 (see FIGS. 4A and 4B) when the pronged arms 18 are in their lowered/extended use position (FIG. 2). The forwardly bent marginal material 24A forms a beam-like flange or lip that aligns with the direction 25 of abutting engagement by the offset bent section 24, thus adding strength to the stop.

It is pointed out specifically that the components of the present invention really reduce down to two structural elements, that being the storage member 14 and the base 12. In the present arrangement, the base 12 captures the prongs against the stud to which it is attached, thus saving components, material, and assembly time, thus simplifying the assembly. In the present arrangement, the storage member 14 is made from a single bent wire or rod, thus saving manufacturing secondary operations such as welding and/or riveting, and reducing related fixturing and quality control problems. This is unlike many other prior art devices having a rotatable arm, which require a complex base structure to house the prong and movably support the prong to allow it to traverse between a stored position and an operating position. These prior art arrangements typically include some additional features such as detents and stops to position the arms correctly, and also a backing plate behind the base plate in order to capture the pronged body itself.

Thus, it can be appreciated that the present invention greatly simplifies the amount of material and componentry needed to achieve the desired result.

In addition to the foregoing, another enhancement on the present embodiment is the inclusion of elastomeric strip or rubber sleeve 17 (FIG. 4) that encircles the bearing area of the pronged body 16 under the brackets 22*a* and 22*b*. The friction from rotating the pronged arms 18 is generated at this point, (i.e. the point between the pronged supports and where they contact the pronged body). It is desirable to have a storage organizer of the present invention that remains in the stored position when the homeowner/user articulates the prongs to that point. Thus, the elastomeric strips or sleeves that circle the pronged body 16 serve to retain the pronged arms 18 in the stored position and to resist the accidental dislodgment, which could cause them to fall.

Turning now to another embodiment of the present invention (FIGS. 5–10), an organizer shelf includes a shelf 40 stamped from sheet metal (or molded from plastic) having a front 42 and a back 44. Also included are the sidewalls or side 46, the front lip 48, the rear lip or rear wall structure 50 and rear mounting holes 52. A bottom panel structure forms a bottom of the shelf 40.

The sidewalls 46 include the side mounting holes 54 (FIG. 9) and the engagement mount 56. The engagement mount 56 includes an upwardly facing notch 57 comprising a rearwardly-facing access opening 56' that opens through the rear wall structure 44 into a vertically elongated retainer portion of the notch in the sidewall 46. Two screws 54' (FIG. 7) are threadably extended into an inside surface of a pair of spaced-apart studs at a location about 1 inch forward of a rear surface of the studs. The screws are only partially installed such that their heads are positioned about one-eighth to one-quarter of an inch outward from the surface of their respective studs. The notch 57 is shaped to receive the head of the screws 54' as the shelf is moved horizontally into the space between the studs, and then interlockingly engage the screws 54' as the shelf 40 is lowered so that the screws engage the vertical elongated retainer portion of the notch 57. The sides of the organizer shelf 40 define a dimension slightly less that 14-12", such as about 14-¼", so that they fit between studs of an unfinished building wall, even if the studs are not perfectly spaced and/or are slightly warped.

FIGS. 5–10 represent various types of installations that the organizer shelf may be arranged in. These installations range from a flat wall application (FIGS. 5–6) to an application in the area in between exposed studs (FIGS. 7 and 9), and to an application where the shelf 40 is mounted onto a perforated panel (FIGS. 8 and 10), such as a pegboard. Each of these arrangements are believed to be novel and very useful, and a single kit capable of being selectively installed in any one of these arrangements is believed to be inventive.

In particular, the organizer shelf of the present invention takes advantage of the fact that in normal stud walls, the studs are organized on 16" centers. (It is also known that in other applications where bearing walls are concerned, the on-center dimension may be increased to 24 inches.) For the purposes of the preferred embodiment, the 16" on-center spacing of the studs results in approximately an open space between the sidewall of each stud equal to 14-½ inches. It is believed that this spacing has never really been taken advantage of in the prior art in terms of being used as part of the mounting system for storage organizers. The present invention leverages the physical properties involved in mounting devices to the sidewall of the studs, which provides an inherently sound structure capable of supporting a great deal of weight, and which, incidentally, adds to the ease of installation for the homeowner/user.

Figure 9:
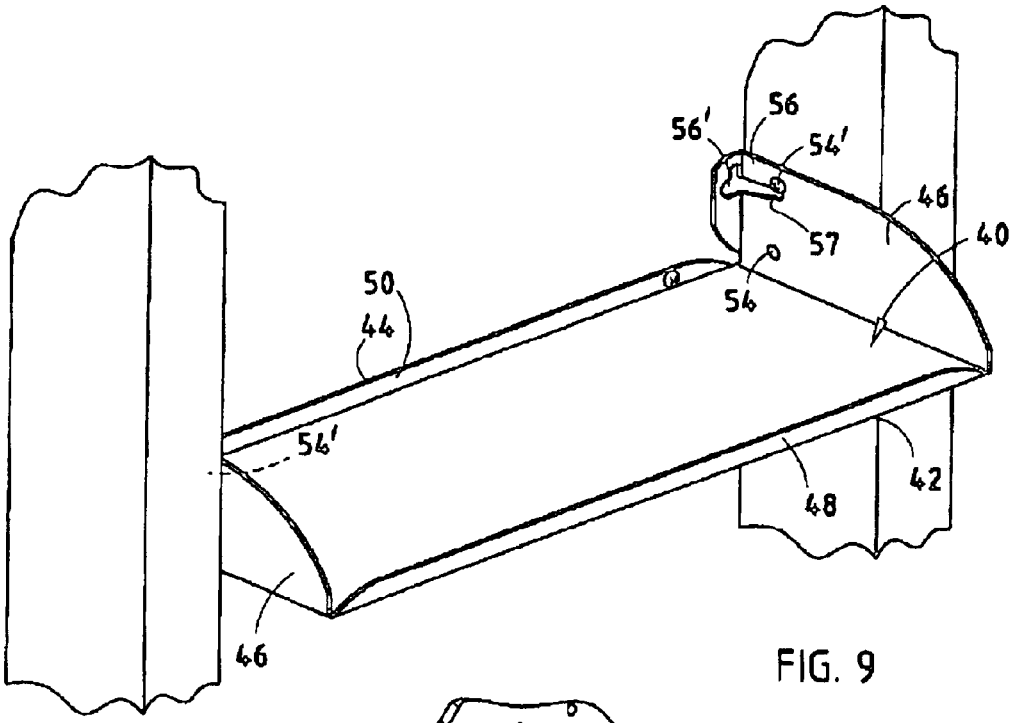
FIGS. 9 and 10 are perspective views of the organizer shelf of FIG. 5, the views being similar to FIGS. 7 and 8 but without any product stored thereon.

As may be better appreciated, in FIG. 9, the installation of an organizer shelf of the present invention is shown with particularity. In this instance, two screws 54' have been attached in the appropriate locations on the opposing sidewalls of two exposed studs. The screw heads are left exposed to an extent consistent with the engagement of the engagement mount 56 of the organizer shelf. The homeowner/user is able to orient the organizer shelf appropriately in between the studs, and to slide it into position where the screws are firmly engaged in the slot or notch 57 formed by the engagement mount 56. Once in place, the homeowner/user may thereafter more firmly attach the products by using a second mounting hole 52 or 54. This would be left at the option of the homeowner/user, since additional engagement would prevent the arbitrary removal of the shelf which in itself may be an advantage depending on the needs and objectives for storage.

Figure 10:
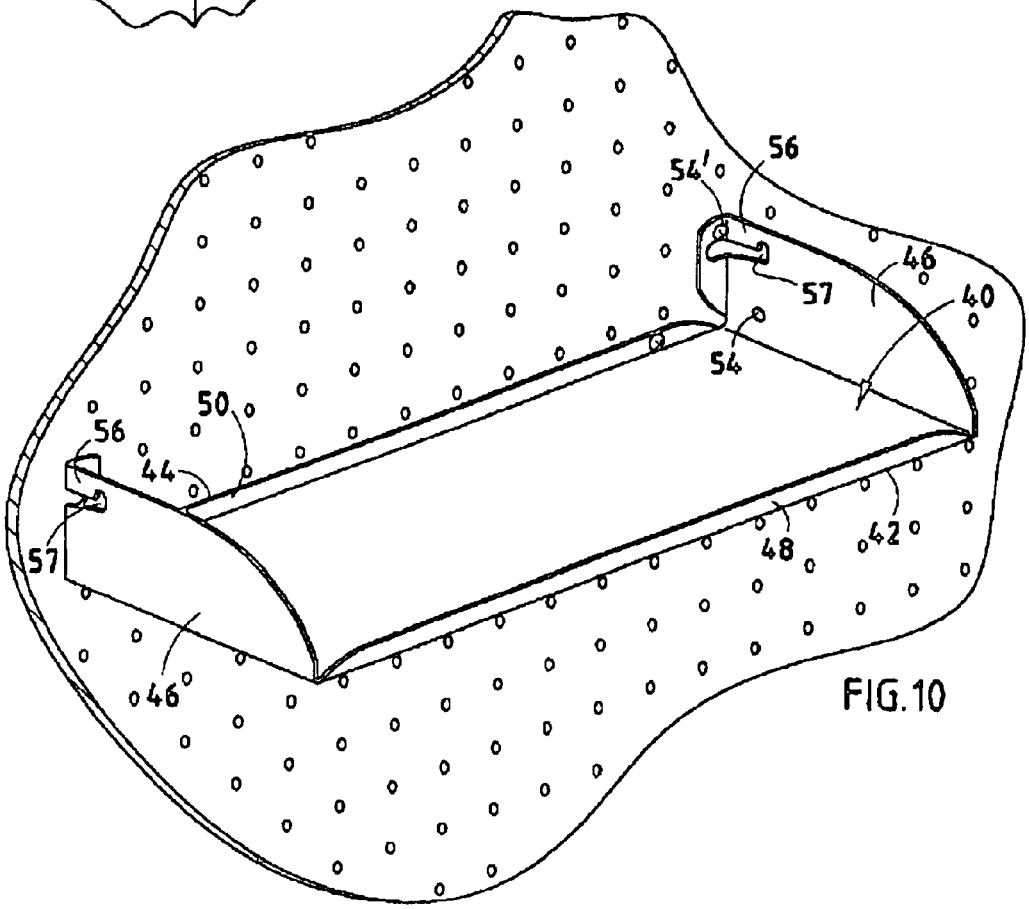

As shown in FIG. 10, an organizer shelf of the present invention may also be installed onto a perforated panel, such as a pegboard. The hole pattern in this instance has been selected to be compatible such that the rear mounting holes 52 align with the spacing of the holes found in a typical pegboard surface, or in the space in between exposed studs, or as may be apparent, for direct mounting onto a flat-walled surface. It is not the intention of the Applicant in any way to minimize the applications in this regard, and the means by which the mounting or the attachment of the shelf to the various surfaces would be well known to persons skilled in the art.

One of the advantages of the present invention lies in the fact that the organizer 60 is formed primarily as a single piece, exclusive of the mounting screws and such, and does not require separate brackets, standards, or shelving components, in order to function as the storage device.

Figure 11:
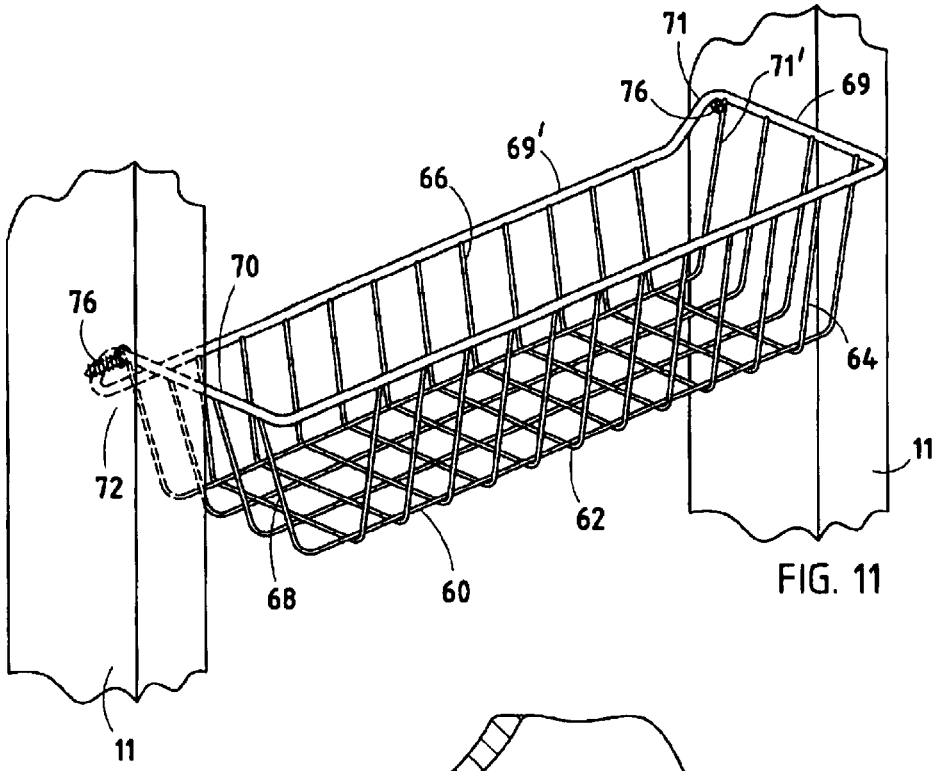
FIG. 11 is a perspective view of a formed-wire organizer of the present invention as mounted in between two exposed studs.

Turning now to FIG. 11, another embodiment of the present invention is disclosed. In this version, a formed-wire organizer 60 is formed substantially of wire. The formed-wire organizer 60 is upwardly open and forms a body 62 of bent-wire segments connected together in an array such as by welding or a coating material. The body 62 includes a front 64, a rear structure 66, a bottom structure, and sides 68. The body 62 includes an upper lip or loop forming a rim 70. Notably, the bottom structure and rear structure are relatively flat and perpendicular to each other, facilitating their use for holding and storing liquid-containing items in an upright position, such as containers of chemicals, and the like. The rim 70 includes linear front and side sections 69 that lie in a same horizontal plane, and further includes a rear section 69' that is horizontal and linear but that is spaced below a height of the front and side sections 69 of the rim 70. An angled rear section 71 extends from each of the side sections 69 and is angled downwardly and connects the rear section 69' to the side sections 69. The angled rear section 71 forms a downwardly open notch (also called an attachment area or engagement area 72) with a wire segment 71' of the sides 68. The notch is V-shaped and is inverted, such that it captures a screw head when the organizer 60 is lowered.

Figure 12:
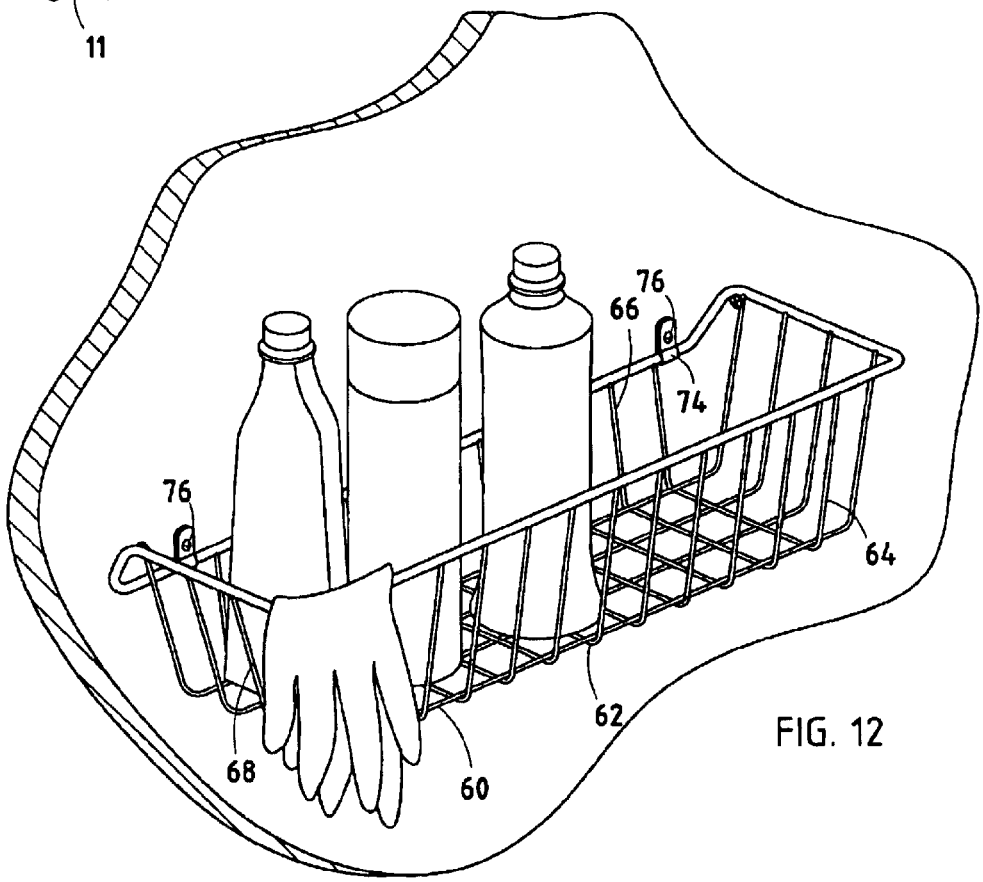
FIG. 12 is a front perspective view of the organizer of FIG. 11 mounted on a flat-walled surface and including containers of products stored thereon.
Figure 13:
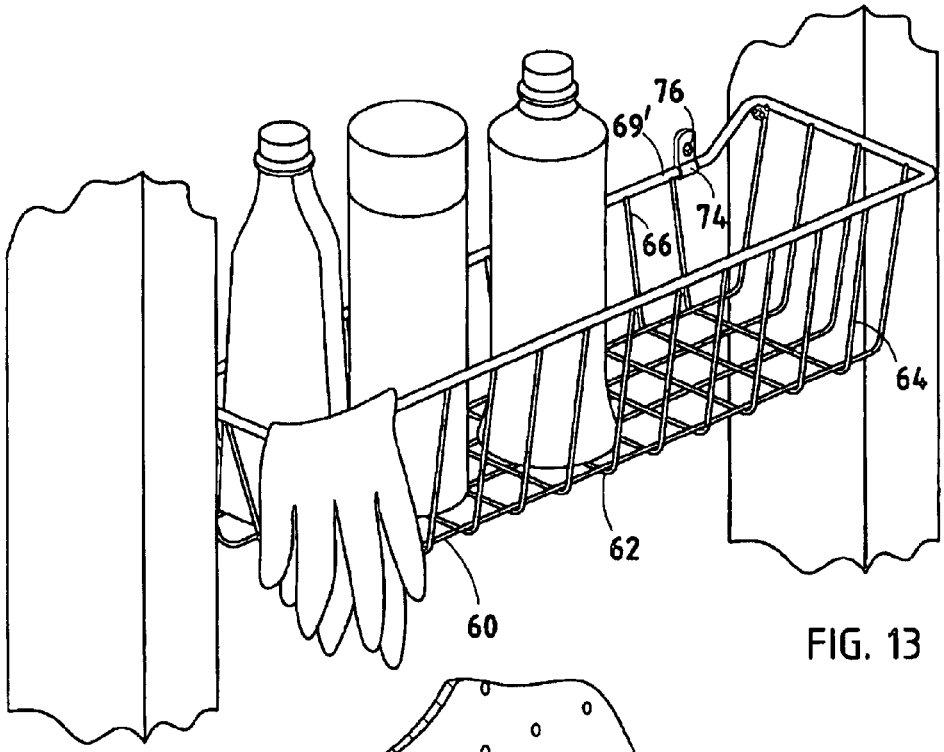
FIG. 13 is a front perspective view of the organizer of FIG. 11 and mounted in between two exposed studs.
Figure 14:
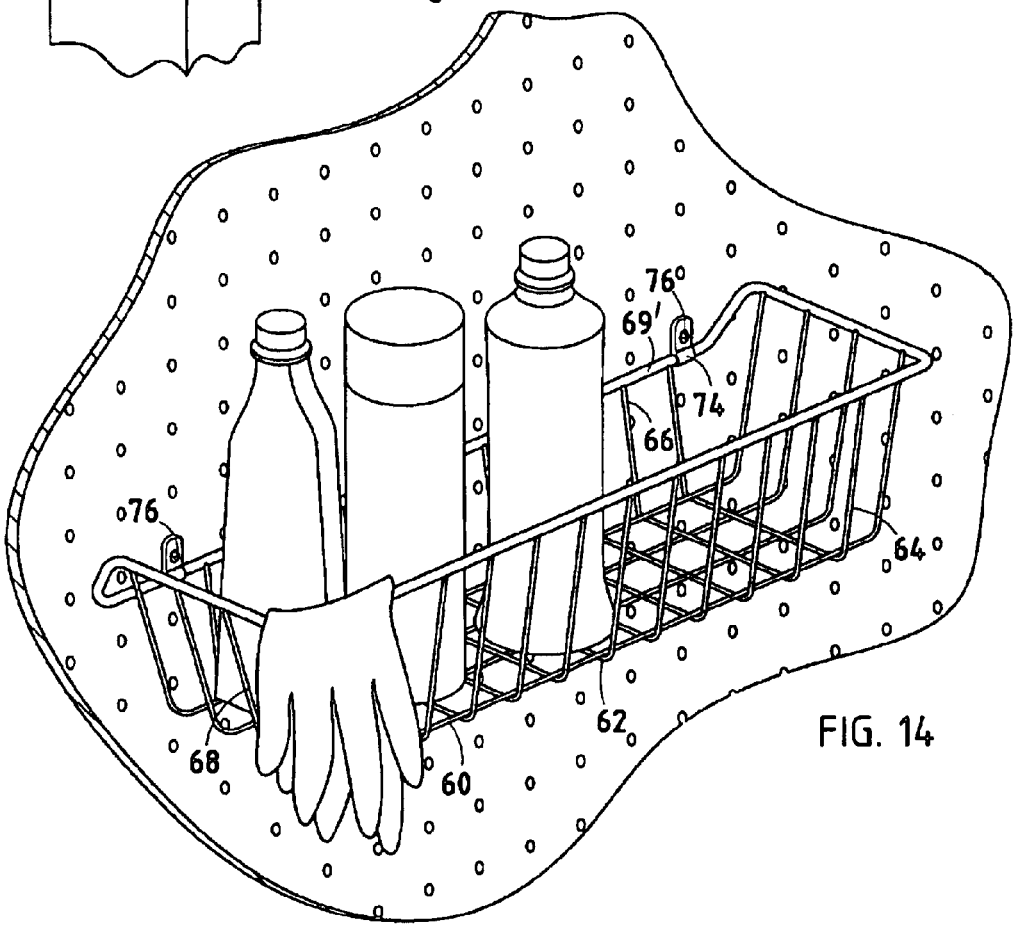
FIG. 14 is a front perspective view of the organizer of FIG. 11 and mounted onto a perforated panel, such as a pegboard.

FIGS. 12, 13, and 14 all show applications in which the organizer 60 of the present invention may be deployed. These range from a flat wall installation as in FIG. 12, to an installation between exposed studs as shown in FIG. 13, and lastly, as installed on a perforated panel (e.g. a pegboard) as shown in FIG. 14.

Figure 16:
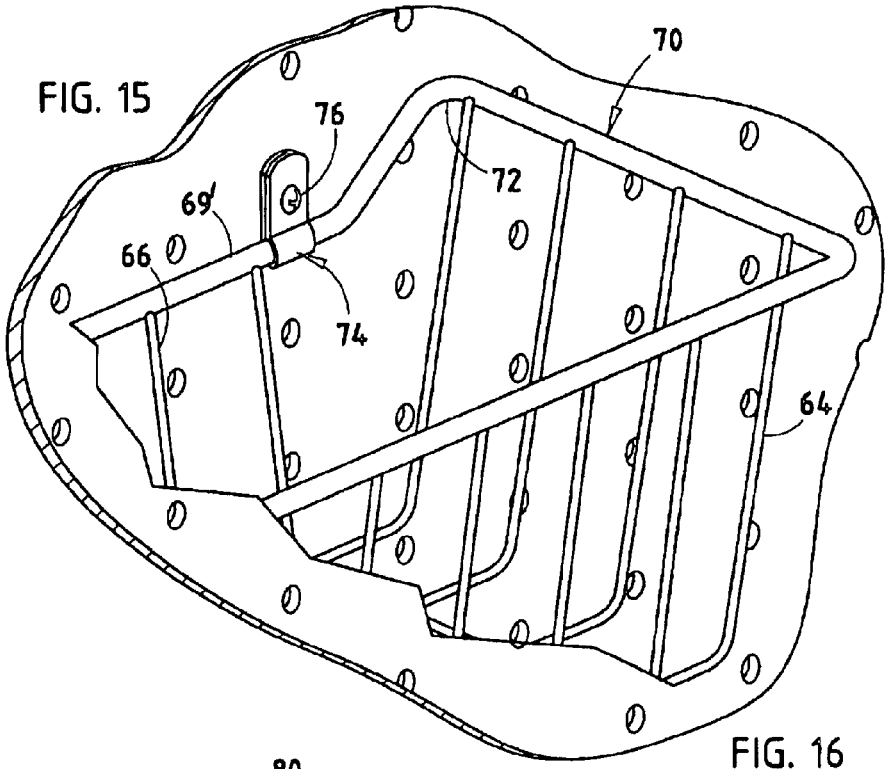
FIG. 16 is a partial perspective view of the organizer of FIG. 11, showing installation of the formed-wire organizer onto a perforated panel, such as a pegboard.

Turning now to FIG. 16, a portion of the formed-wire organizer 60 is shown near the intersection of the rear and side portions. In particular, there is identified the engagement area or notch 72, which, in this case, is located in close proximity to the mounting bracket 74, which is also shown with the top of the screw 76. First, the engagement area 72 itself serves a similar function as the notch 57 of the engagement mount 56 of the organizer shelf 40, since it is useful in conjunction with installation upon the inwardly-facing surfaces of two exposed studs. Referencing back to FIG. 11, it can be appreciated that the screw heads are exposed by partial installation into the sidewalls of the two exposed studs as shown in the drawing. As a result, the exposed screw heads and screw shanks fit within the engagement area 72 in a manner that supports the formed-wire organizer 60 by allowing the rim 70 to rest on top of the shank of the slightly exposed screws. Much like as was described for the organizer shelf 40, the formed-wire organizer 60 is easily installed in this position and makes a new and unique use of the area in between the exposed studs. As shown in FIG. 11, a panel or board attached to a rear of the studs 11 engages a rear of the sides 68 and bottom, causing with the screws a torque on the organizer 60 that supports the organizer 60, even though the front 64 of the organizer 60 extends forward of the studs 11.

Figure 18A:
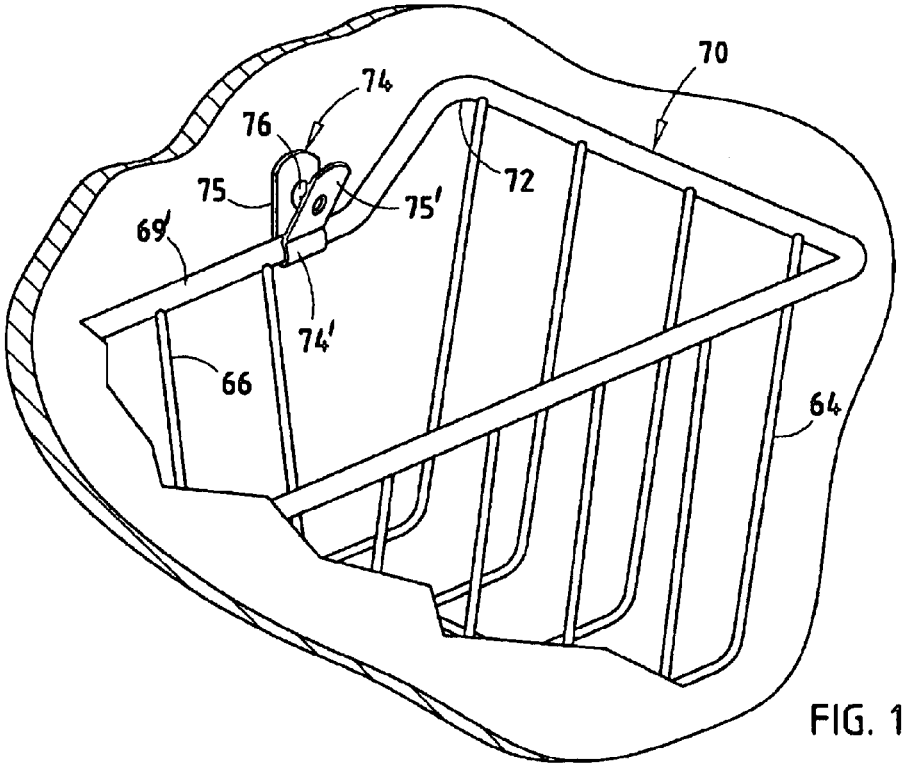
FIG. 18A is a partial perspective view similar to FIG. 18, but with the wrap-around clip in a partially-open, snap-attach, releasable installation position.
Figure 18:
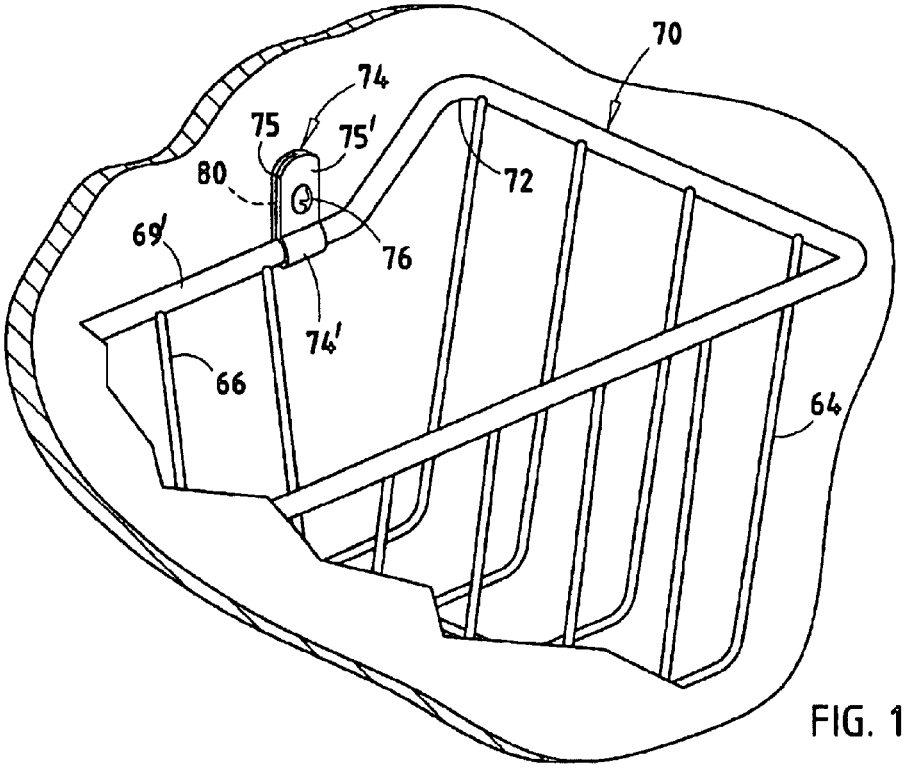
FIG. 18 is a partial perspective view of a formed-wire organizer of the present invention as installed onto a flat-walled surface, such as to a gypsum wallboard, using a wrap-around clip in a fully closed non-releasing installation position.

The mounting bracket 74 is configured to assist in the installation of the present invention onto the flat-walled surface or, in the alternative, onto the perforated panel, such as a pegboard. The mounting bracket 74 (FIG. 18) comprises a strip with a center section 74' wrapped around the rear section 69' of the rim 70, and having first and second legs 75 and 75' lying substantially adjacent and parallel each other. As shown in FIG. 18, if the screw 76 is extended through both of the legs 75 and 75', then the organizer 60 is permanently secured to the supporting structure or studs to which it is attached. As shown in FIG. 18A, if the screw 76 is extended through only one of the legs (such as only through leg 75), then the bracket 74 forms an upwardly open latch permitting the rear section 69' of the rim 70 to be snapped downwardly into (or upwardly out of) engagement with the bracket 74 (i.e. between legs 75 and 75'). The bracket 74 is resilient but stiff, such that leg 75' can be resiliently flexed inwardly and/or outwardly. Thus, this novel arrangement allows the formed-wire organizer 60 to be releasably and snappingly held by the bracket 74 for quick removal (without the need to remove screw(s) 76). At the same time, the bracket 74 is both simple and flexible in its attachment to various supporting structures, such as to a perforated panel (by using anchors), to a gypsum panel, to a flat surface, and/or to studs.

Figure 15:
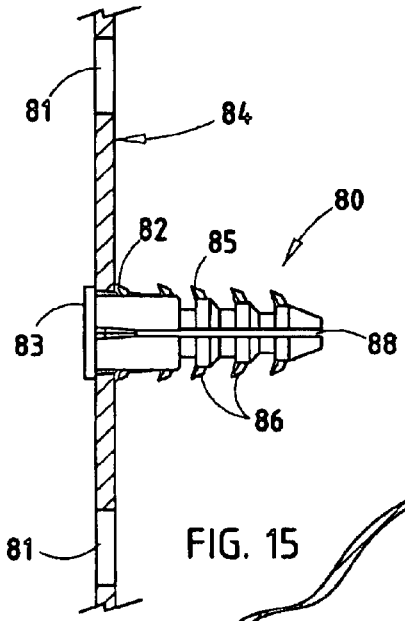
FIG. 15 is a side cross-sectional view of an anchor extended into a hole in a perforated panel, such as a sheet metal panel, for mounting any of the organizers of the present invention onto the perforated panel.

Referencing now FIG. 15, a cross-sectional view of a perforated panel is shown where a unique plastic anchor 80 is inserted into a selected one of the holes 81. The anchor 80 includes barbs 82 positioned relatively close to anchor head 83 for engaging a thin perforated panel 84, such as a sheet metal panel, and also includes second barbs 85 positioned to engage a thicker panel, such as a pegboard panel made of a wood product. The anchor 80 also includes additional barbs 86 positioned to engage a still thicker panel, such as a ½", ¾", or 1" drywall or gypsum board panel. The anchor 80 includes slots 88 that divide a tip of the anchor into halves and further includes a center hole 89, such that upon insertion of an appropriate screw into the hole 89, the halves spread apart and frictionally engage the hole (e.g. hole 81) into which the anchor 80 is placed. A unique feature of the anchor 80 is the location of the barbs 82 and 85 relative to the anchor head 83 and to an end of the slots 88. The barbs 82 and 85 are located to engage and grab the back surface of specific thicknesses of perforated panels, including thin perforated panels, thus preventing the anchors 80 from being pulled out of the panels upon insertion of a screw.

Figure 17:
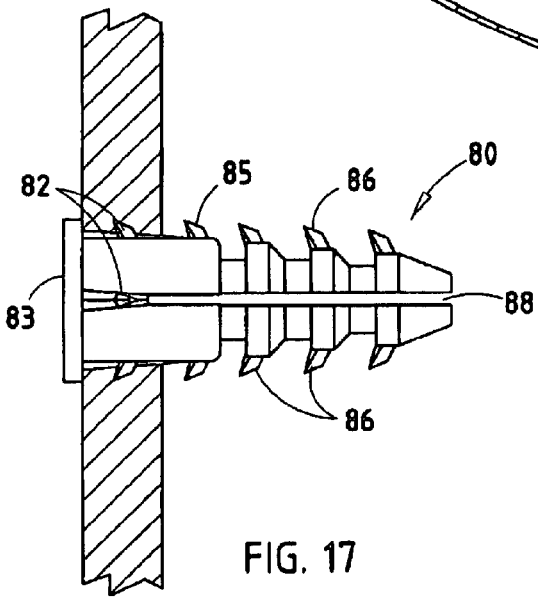
FIG. 17 is a side cross-sectional view showing an anchor installed in a flat-walled surface, such as gypsum panel, for mounting any of the organizers of the present invention onto a flat-walled surface.
Figure 17A:
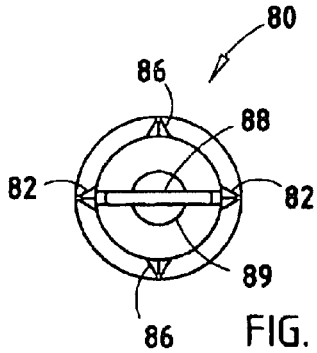
FIG. 17A is an end view of the anchor shown in FIG. 17.

Similarly, with reference to FIGS. 17 and 18, the usage of a plastic anchor for a drywall panel is shown. Once installed, the usage of an appropriate screw through the same mounting bracket 74 results in an affirmative installation of the formed-wire organizer 60 to a drywall surface. It should be noted that the anchor 80 (FIG. 17) could similarly be used to install the organizer shelf 40 (FIGS. 5–6) to a drywall surface. It should also be noted that the anchor 80 could be used to install organizers on other types of solid walls.

An objective in the case of the formed-wire organizer 60 as is shown for the organizer shelf 40 is the extremely compatible installation modes that are obtained using the present design. As mentioned previously, the fact that a complete unit is essentially obtained in one article without additional brackets, supports, or shelving surfaces, is both economical and convenient for the homeowner/user.

It may be understood and appreciated that the embodiments of the present invention are typically and preferably constructed from metal, plastic (reinforced or non-reinforced) or composite. Each may be finished in accordance with the desires and objectives of one who is manufacturing such articles. It is noted that, where steel is used, it is often painted, dipped, or otherwise coated so as to minimize corrosion and to enhance cosmetic quality.

The fastening methods as shown above are merely illustrative of the potential fastening methods that may be conceived. For instance, it is possible that if the application is extended to a surface that is a metal or plastic sheet, rivets, nuts, bolts, and alternative fasteners could be used. Additionally, variations in the width and/or depth of the embodiments can be made in accordance with the applications. As discussed above, in the case of some load-bearing walls, the centers for stud installation are varied to lower construction cost, such as by increasing the spacing of centers to 24 inches. Thus, embodiments of the present invention could be optimized for this type of installation as well as by providing a narrower width or wider width, which would be compatible for installation between exposed studs in those circumstances.

These and other attributes of the disclosed embodiments may be appreciated both from the drawings and the descriptions above. The Applicant does not intend in any way to limit the applications of his concepts by restricting them precisely to the models given above.

The invention claimed is:

1. A storage organizer adapted for attachment to a structure having a flat surface for creating storage thereon, comprising:

a base plate including material bent to form at least one open-sided support pocket, the at least one open-sided support pocket defining at most one-half of a pivot and defining a horizontal axis of rotation but being adapted to be closed to define the pivot only when the base plate is attached to the structure; and a U-shaped storage member having a pronged body and pronged arms extending from the pronged body, the pronged body having at least one straight section positioned within the support pocket for rotation about the axis of rotation with the pronged arms being movable between an upright non-use position and a downwardly-pivoted extended use position, the pronged body further having an offset bent section integral with and extending from the straight section, the offset bent section being bent at a predetermined angle relative to the pronged arms so that, when the pronged arms are in the extended use position, the offset bent section engages the base plate to hold the pronged arms in the extended use position.

2. The storage organizer defined in claim 1, wherein the at least one support pocket includes a pair of spaced-apart support pockets.

3. The storage organizer defined in claim 2, wherein the pair of support pockets are defined by bands that form half-cylinder shapes on the base plate.

4. The storage organizer defined in claim 1, wherein the base plate comprises a stamped one-piece plate with integral top and bottom plate sections that define a flat rear surface and with the material of the base plate forming a pair of integral bands extending between the top and bottom plate sections to form an aligned pair of the at least one support pocket.

5. The storage organizer defined in claim 1, wherein the storage organizer includes only two structural components those being the base plate and the storage member.

6. The storage organizer defined in claim 1, including friction-generating material on the straight section and in the pocket for generating friction to prevent the storage member from undesirably rotating.

7. The storage organizer defined in claim 1, wherein the base plate and the storage member are each constructed from contiguous and continuous metal and are characterized by an absence of welds and rivets.

8. A storage organizer adapted for attachment to a structure having a flat surface for creating storage thereon, comprising:

a base plate including material bent to form at least one open-sided support pocket, the at least one a open-sided support pocket defining a horizontal axis of rotation but being closed to define a pivot only when the base plate is attached to the structure; and a U-shaped storage member having a pronged body and pronged arms extending from the pronged body, the pronged body having at least one straight section positioned within the support pocket for rotation about the axis of rotation with the pronged arms being movable between an upright non-use position and a downwardly-pivoted extended use position, the pronged body further having an offset bent section integral with and extending from the straight section, the offset bent section being bent at a predetermined angle relative to the pronged arms so that, when the pronged arms are in the extended use position, the offset bent section engages the base plate to hold the pronged arms in the extended use position;

wherein the base plate comprises a stamped one-piece plate with integral top and bottom plate sections that define a flat rear surface and with the material of the base plate forming a pair of integral bands extending between the top and bottom plate sections to form an aligned pair of the at least one support pocket;

wherein an area between the pair of bands is cutout and forms a window horizontally between the bands and vertically between the top and bottom plate sections, the base plate including marginal material at a bottom of the window that forms a stop located for engagement with the offset bent section when the pronged arms are in the use position.

9. A storage organizer adapted for attachment to a structure having a flat surface for creating storage thereon, comprising:

a base plate including material bent to form at least one open-sided support pocket, the at least one open-sided support pocket defining a horizontal axis of rotation but being closed to define a pivot only when the base plate is attached to the structure; and a U-shaped storage member having a pronged body and pronged arms extending from the pronged body, the pronged body having at least one straight section positioned within the support pocket for rotation about the axis of rotation with the pronged arms being movable between an upright non-use position and a downwardly-pivoted extended use position, the pronged body further having an offset bent section integral with and extending from the straight section, the offset bent section being bent at a predetermined angle relative to the pronged arms so that, when the pronged arms are in the extended use position, the offset bent section engages the base plate to hold the pronged arms in the extended use position;

wherein the body of the U-shaped storage member includes a pair of the straight sections connected together by the offset bent section, the base including a forwardly bent marginal material under the offset bent section that engages the offset bent section when the pronged arms are in the extended use position.

10. The storage organizer defined in claim 9, wherein an angle of the pronged arms when in the use position is about 5° to 15° above horizontal so that items stored on the pronged arms do not fall off.

11. A storage organizer adapted for attachment to a structure having a flat surface for creating storage thereon, comprising:

a base plate including material bent to form at least one open-sided support pocket, the at least one open-sided support pocket defining a horizontal axis of rotation but being closed to define a pivot only when the base plate is attached the wall structure; and a U-shaped storage member having a pronged body and pronged arms extending from the pronged body, the pronged body having at least one straight section positioned within the support pocket for rotation about the axis of rotation with the pronged arms being movable between an upright non-use position and a downwardly-pivoted extended use position, the pronged body further having an offset bent section integral with and extending from the straight section, the offset bent section being bent at a predetermined angle relative to the pronged arms so that, when the pronged arms are in the extended use position, the offset bent section engages the base plate to hold the pronged arms in the extended use position; and friction-generating material on the straight section and in the pocket for generating friction to prevent the storage member from undesirably rotating, the friction-generating material comprising an elastic band.

12. A storage organizer adapted for attachment to a building wall for creating storage thereon, comprising:

a base plate including upper and lower attachment sections connected together by forwardly bent material forming at least one rearwardly-open support pocket, each support pocket defining at most one-half of a pivot, the base plate being open along its rear side at and between the at least one support pocket but when the base plate is attached to a building wall, being adapted to be closed to define horizontal axis of rotation at the pivot; and a bent wire storage member having a straight section rotatably positioned in the at least one support pocket and pronged arms extending from the straight section, the storage member being rotatable to move the pronged arms between an upright non-use position and a downwardly-pivoted extended use position, the storage member further having an offset bent section integral with and extending from the straight section, the offset bent section being bent at a predetermined angle relative to the pronged arms so that, when the pronged arms are in the extended use position, the offset bent section engages the base plate to hold the pronged arms in the extended use position.

13. The storage organizer defined in claim 12, wherein the storage organizer includes only two structural components, those being the base plate and the storage member.

14. The storage organizer defined in claim 12, including a strip of frictional material between the base plate and the storage member for generating friction to hold the storage member in the use and non-use positions.

15. An apparatus including a building wall including a flat front surface, and the storage organizer defined in claim, 12 attachment sections being attached to the flat front surface.

16. A storage organizer adapted for attachment to a building wall for creating storage thereon, comprising:

a base plate including upper and lower attachment sections connected together by forwardly bent material forming at least one rearwardly-open support pocket, with the base plate being open along its rear side at and between the at least one support pocket but being adapted to, only when the base plate is attached to a building wall, be closed to define a pivot having a horizontal axis of rotation; and a bent wire storage member having a straight section rotatably positioned in the at least one support pocket and pronged arms extending from the straight section, the storage member being rotatable to move the pronged arms between an upright storage position and a downwardly-pivoted extended use position, the storage member further having an offset bent section integral with and extending from the straight section, the offset bent section being bent at a predetermined angle relative to the pronged arms so that, when the pronged arms are in the extended use position, the offset bent section engages the base plate to hold the pronged arms in the extended use position; and the base plate further including second forwardly bent material that forms a beam-like lip that engages the offset bent section of the storage member when the storage member is moved to the non-use position, the second forwardly beat material having a length that aligns with a direction of engagement of the offset bent section as the offset bent section is moved to the use position and being configured to hold the storage member in the use position, even when items are hung on the pronged arms.

17. A storage organizer adapted for attachment to a building wall for creating storage thereon, comprising a base plate including attachment sections adapted for attachment to the building wall, the attachment sections being connected together by a pair of forwardly bent bands that form a pair of rearwardly-open support pockets that, only when the base plate is attached to the building wall, are closed and define a horizontal axis of rotation, the base plate further including forwardly bent marginal material between and at a bottom of the bands and having a length; and a preformed storage member having a pair of straight sections rotatably positioned in the support pockets and at least one pronged arm extending from the straight sections, the storage member being rotatable to move the at least one pronged arm between an upright non-use position and a downwardly-pivoted extended use position, the storage member further having an offset bent section integral with and located between the straight sections, the offset bent section being bent at a predetermined angle relative to the at least one pronged arm so that, when the pronged arm is in the extended use position, die offset bent section engages the forwardly bent marginal material in a direction of engagement aligned with the length to hold the pronged arm in the extended use position, with the forwardly bent marginal material forming a beam of increased strength due to its alignment with the direction of engagement.

18. The storage organizer defined in claim 17, wherein the storage organizer includes only two structural components, those being the base plate and the storage member.

19. The storage organizer defined in claim 17, including a strip of frictional material between the base plate and the storage member for generating friction to hold the storage member in the use and non-use positions.

20. An apparatus including a building wall including a flat front surface, and the storage organizer defined in claim 17 attachment sections being attached to the flat front surface.

21. The storage organizer defined in claim 17, wherein first torsional forces generated by engagement of the offset section against the forwardly bent marginal material when in the use position are counterbalanced by second torsional forces generated by engagement of a top section of the bands against the straight sections.

22. A storage organizer adapted for attachment to a building wall far creating storage thereon, comprising:

a base plate including forwardly bent material forming at least one rearwardly-open support pocket, with the at least one support pocket being adapted to, when the base plate is attached to a building wall, define a pivot having a horizontal axis of rotation; and a storage member having at least one straight section rotatably positioned in the at least one support pocket and at least one pronged arm extending from the straight section, the storage member being rotatable to move the at least one pronged arm between an upright non-use position and a downwardly-pivoted extended use position, the storage member further having an offset bent section integral with and extending from the straight section, the offset bent section being bent at a predetermined angle relative to the pronged arms so that, when the pronged arms are in the extended use position, the offset bent section engages the base plate to hold the pronged arms in the extended use position, with first torsional forces generated by engagement of the offset section against the forwardly bent marginal material when in the use position being counterbalanced by second torsional forces generated by engagement of a top section of the bands against the straight sections.

23. The storage organizer defined in claim 22 the at least one support pocket defines a completely open area on a rear side of the base plate, and wherein the storage organizer includes only two structural components, those being the base plate and the storage member, and further wherein the base plate further has a thickness and includes second forwardly bent material that engages the offset bent section of the storage member when the storage member is moved to the non-use position, the second forwardly bent material having a length that aligns with a direction of engagement of the offset bent section as the offset bent section is moved to the use position, the length being longer than the thickness so that the second forwardly bent material has increased beam strength to hold the storage member in the use position, even when items are hung on the pronged arms.

24. The storage organizer defined in claim 22 including a strip of frictional material between the base plate and the storage member for generating friction to hold the storage member in the use and non-use positions.

* * * * *